US007314386B2

(12) United States Patent
Kao

(10) Patent No.: US 7,314,386 B2
(45) Date of Patent: Jan. 1, 2008

(54) CABLE CONNECTOR WITH ANTI-ELECTROMAGNETIC INTERFERENCE CAPABILITY

(75) Inventor: Shin-Shun Kao, Jhonghe (TW)

(73) Assignee: T-Conn Precision Corp.

( * ) Notice: Subject to any disclaimer, the term of this patent is extended or adjusted under 35 U.S.C. 154(b) by 0 days.

(21) Appl. No.: 11/161,457

(22) Filed: Aug. 4, 2005

(65) Prior Publication Data

US 2007/0032133 A1 Feb. 8, 2007

(51) Int. Cl.
*H01R 13/648* (2006.01)

(52) U.S. Cl. ..... 439/607

(58) Field of Classification Search ..... 439/607, 439/610, 108, 98, 930, 578, 355
See application file for complete search history.

(56) References Cited

U.S. PATENT DOCUMENTS 5,380,223 A * 1/1995 Marsh et al. ..... 439/610
6,162,086 A * 12/2000 Kuo ..... 439/497
6,413,112 B2 * 7/2002 Semmeling et al. ..... 439/358
6,811,438 B1 * 11/2004 Ko ..... 439/607
6,966,797 B2 * 11/2005 Ko ..... 439/610

* cited by examiner

*Primary Examiner*—Chandrika Prasad
(74) *Attorney, Agent, or Firm*—Morris Lin; T-Conn Precision Corp.

(57) ABSTRACT

The present invention provides a cable connector. The cable connector comprises a first metal case, a second metal case, a support base, a terminal base and a cable. The base of the support base is positioned in the first metal case such that the hollow threaded fastener of the support base passes through the through hole of the first metal case. The cable is passed through the hollow threaded fastener of the support base. The second metal case is assembled to the first metal case such that the connecting holes formed on the sidewalls of the second metal case buckle the slots formed on the sidewalls of the first metal case. The protruding blocks of the second metal case are bent toward the first metal case to securely cover the first metal case.

6 Claims, 6 Drawing Sheets

CABLE CONNECTOR WITH ANTI-ELECTROMAGNETIC INTERFERENCE CAPABILITY

FIELD OF THE INVENTION

The present invention generally relates to a cable connector, and more particularly to a cable connector in which all components are properly secured so that the anti-electromagnetic interference capability of the cable connector can be effectively promoted.

DESCRIPTION OF THE RELATED ART

The conventional "cable components", such as disclosed in publication No. 093204634 published in Patent Bulletin of the Republic of China, includes an insulator, a metal cover for covering the insulator, a space for the insulator and a adaptor. A plurality of conductive terminals is disposed inside the insulator. The adapter has a connecting area extending through the opening at the long side of the metal cover. The adaptor has a hole for the cable to pass through and lead the cable to the space inside the metal cover so that the core wires of the cable may be connected to the conductive terminals disposed inside the insulator.

Even though the design of the cable connector described above is capable of reducing the height and also capable of reducing electromagnetic interference, however, there is no structure for properly securing the connection among the adaptor, the cable and the sleeve. The connection between the first and second parts of the metal cover is merely connected by the concave and convex ends, and therefore the anti-electromagnetic interference effect of the conventional cable connector is limited.

SUMMARY OF THE INVENTION

Accordingly, the present invention is directed to a structure of a cable connector wherein connections among all components of the cable connector are properly secured to improve the anti-electromagnetic interference capability of the cable connector. The cable connector comprises a first metal case, a second metal case, a support base, a terminal base and a cable. The second metal case is adopted for covering the first metal case for improving the anti-electromagnetic interference effect of the cable connector.

The second metal case comprises protrusions formed on sidewalls thereof corresponding to the slots of the first metal case. A first projection and a second projection are disposed on the end portions of the second metal case. The support base comprises a base and a hollow threaded fastener, wherein the hollow threaded fastener may be passed through the through hole of the first metal case, wherein the base comprises a connector for connecting to the connector and a sleeve on the hollow threaded fastener. The terminal base is disposed between the second metal case and the support base. The cable is passed through the hollow threaded fastener and connected the terminal base.

DESCRIPTION OF THE EMBODIMENTS

The features and the advantages of the present invention will be more readily understood upon a thoughtful deliberation of the following detailed description of a preferred embodiment of the present invention with reference to the accompanying drawings.

Figure 1:
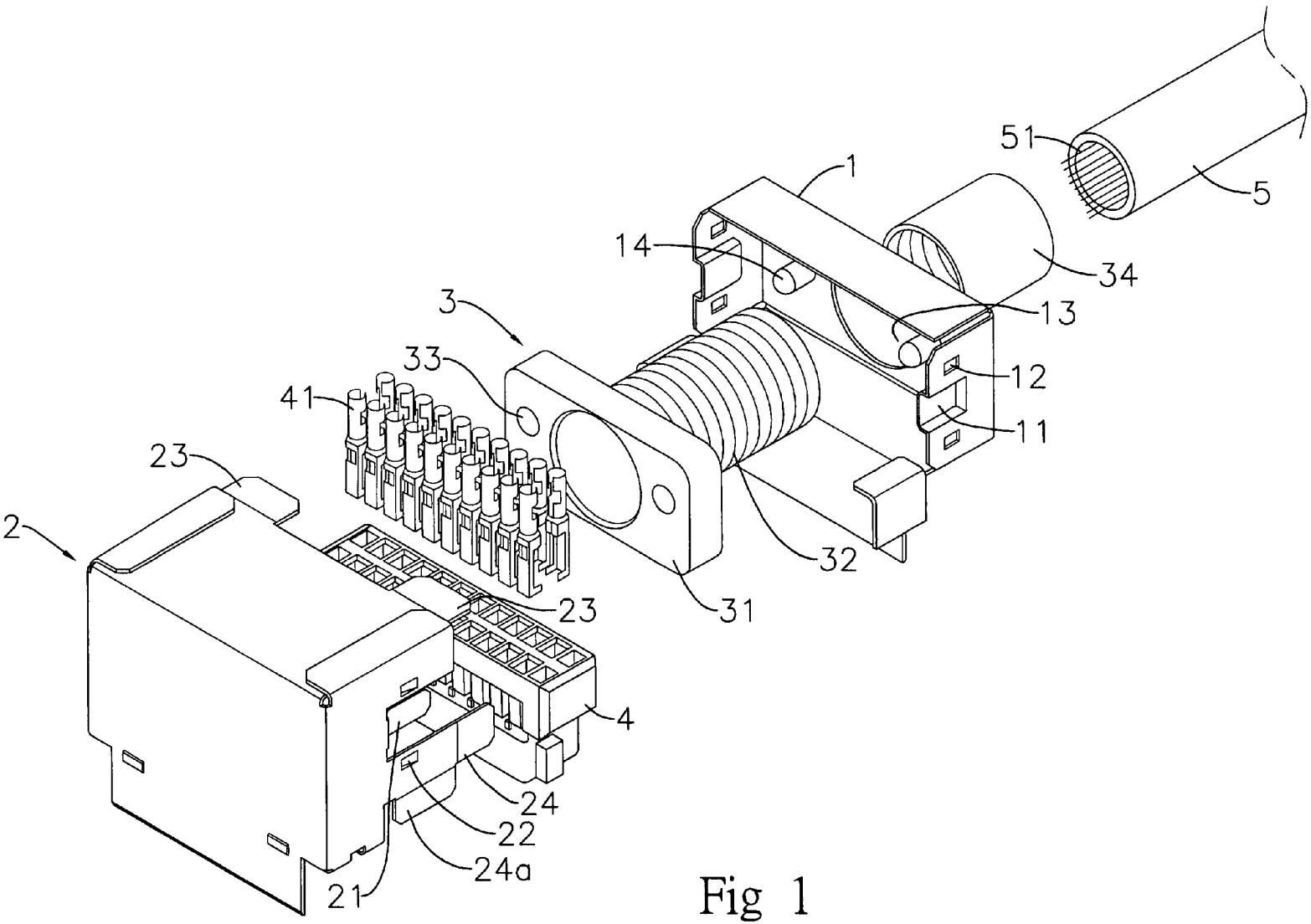
FIG. 1 shows an exploded view of a cable connector according to an embodiment of the present invention.

FIG. 1 is the perspective view of a cable connector according to an embodiment of the present invention. As shown in FIG. 1, the cable connector comprises a first metal case 1, a second metal case 2, a support base 3, a terminal base 4 and a cable 5. All the aforementioned components are securely assembled together, wherein the second metal case covers the first metal case. Thus, the anti-electromagnetic interference capability of the cable connector may be effectively promoted.

The first metal case 1 comprises slots 11 formed on sidewalls thereof, wherein connecting holes 12 are formed on two ends of each slot 11. A through hole 13 is formed at a central region of the rear surface of the first metal case 1. Pins 14 are disposed on two sides of through hole 13.

The second metal case 2 comprises projections 21 formed on the sidewalls thereof positioned correspondingly to the slots 11 formed on the sidewalls of the first metal case 1. Indented protruding blocks 22 are disposed on two end portions of the projections 21, wherein the indented protruding blocks may be adopted for connecting to the connecting holes. A first projection 23 is disposed on one end portion of the second metal case 2, and second projections 24, 24*a* are disposed close to the projections 21 formed on the sidewalls of the second metal case 2.

The support base 3 comprises a base 31. A hollow threaded fastener 32 extends from one side of the base 31, wherein the hollow threaded fastener 32 may be passed through the through hole 13 of the first metal case 1. The base 31 comprises a connector 33 for connecting to the connector 14 of the first metal case 1. The connector 33 comprises a through hole and the hollow threaded fastener 32 is adopted for connecting to the sleeve 34, wherein the sleeve 34 comprises a spiral configuration.

The terminal base 4 comprises a plurality of contact terminals formed thereon, wherein the terminal base is disposed between the second metal case 2 and the support base 3.

The cable 5 comprises a plurality of core wires 51 and may be passed through the hollow internally threaded fastener 32 of the support base 3, wherein the core wires 51 may be electrically connected to the contact terminals 41.

Figure 2:
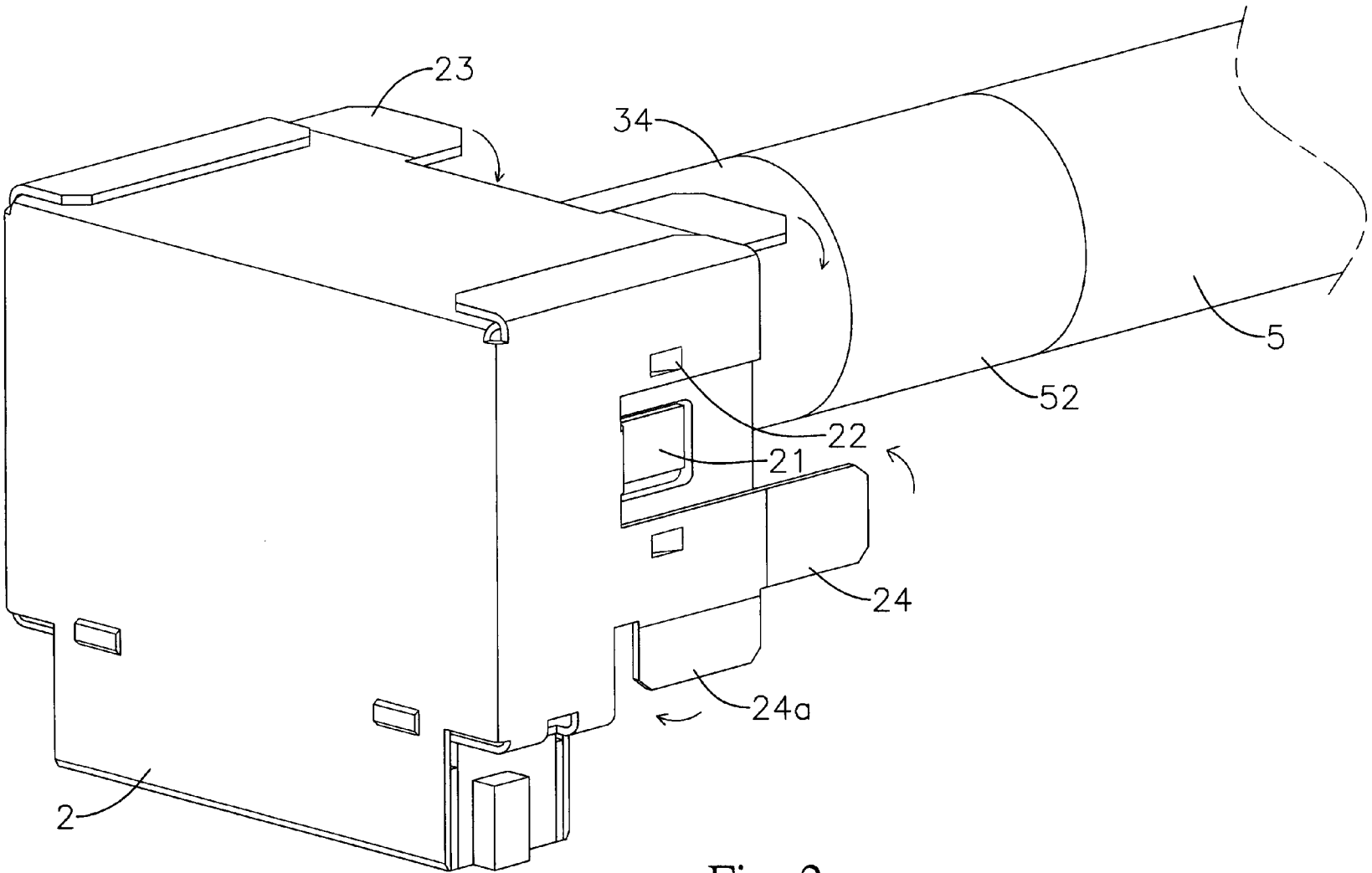
FIG. 2 shows a perspective view of a cable connector according to an embodiment of the present invention.
Figure 3:
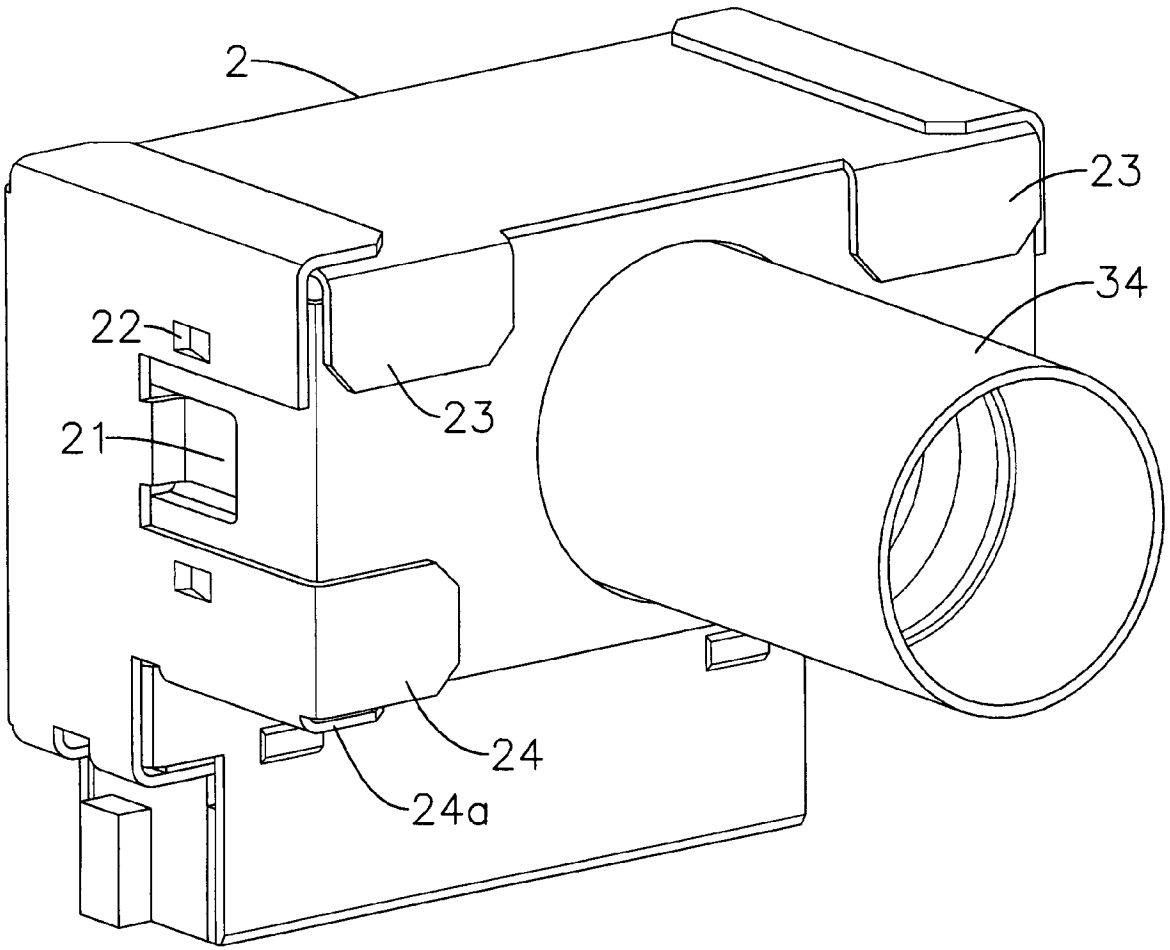
FIG. 3 shows an assembled view of a cable connector according to an embodiment of the present invention.

Hereinafter, assembly of the cable connector, according to an embodiment of the present invention, will be described with reference to FIGS. 1, 2 and 3. First, the hollow threaded fastener 32 of the support base 3 is passed through the through hole 13 of the first metal case 1. Next, the connector 33 of the base 31 is connected to the connector 14 of the first metal case 1. The cable is passed through the hollow threaded fastener 32 of the support base 3, and then the core wires 51 are electrically connected to the contact terminals 41. Next, the sleeve 34 is disposed over the hollow threaded fastener 32. Furthermore, a nut, pad or ring (not shown in the figure) may be adopted for securing the hollow threaded fastener 32 and the sleeve 34 in position, and a heat-shrinkable tube 52 may be placed on the exposed portion of the cable 5 and the sleeve 34 for securing the cable in position. The projections 21 formed on sidewalls of the second metal case 2 are buckled to the slots of the first metal case 1. The indented protruding blocks 22 formed adjacent to the projections 21 are connected to the connecting holes of the first metal case 1. Finally, the first projection 23 and the second projections 24 24*a* of the second metal case 2 are bent toward one side of the first metal case 1 for securely covering and retaining the first metal case 1 within the second metal case 2. Thus, the assembly of the components of the cable connector can be substantially simplified and properly secured, and the anti-electromagnetic capability of the cable connector may be effectively promoted.

Figure 4:
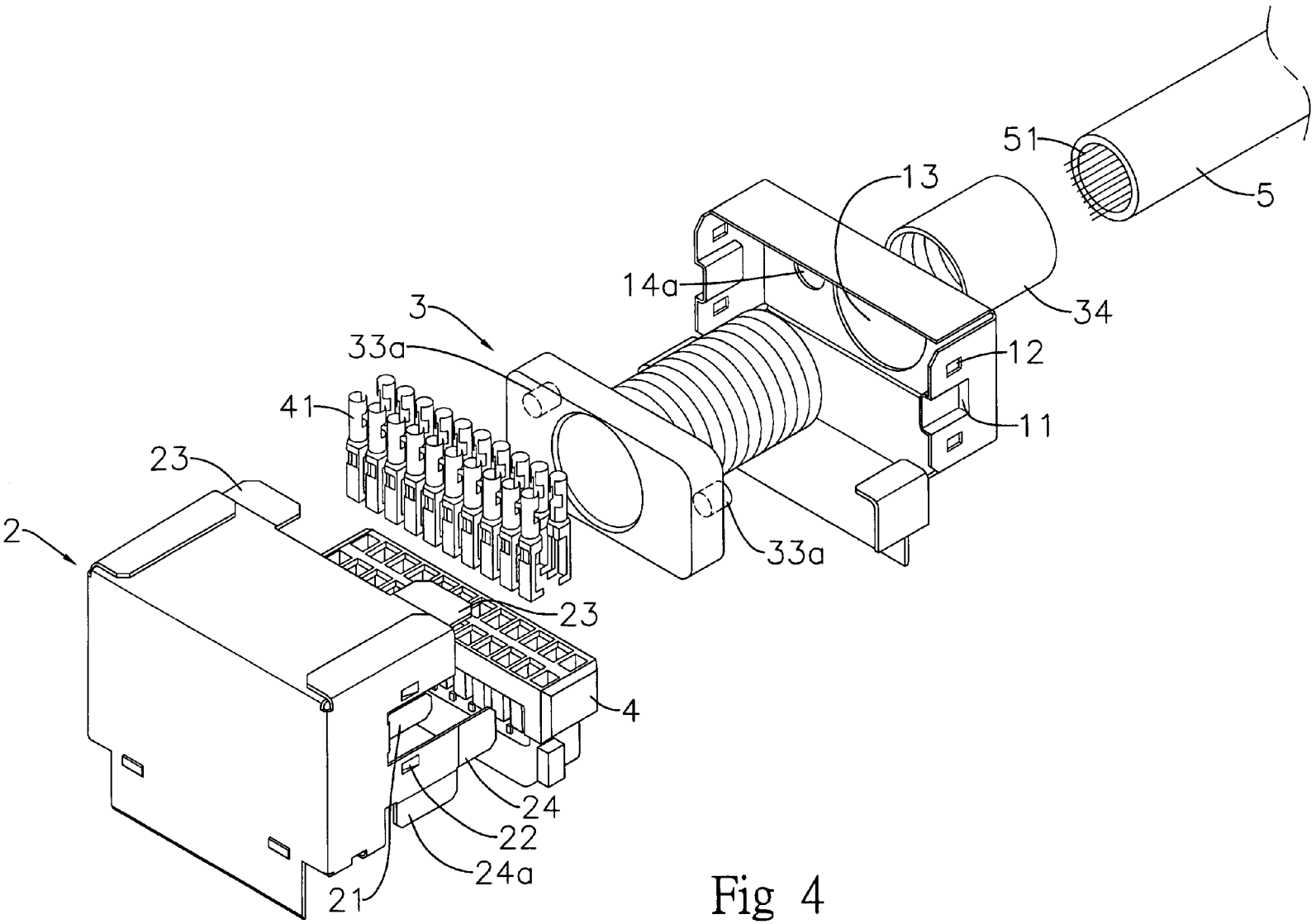
FIG. 4 shows an exploded view of a cable connector according to an embodiment of the present invention.
Figure 5:
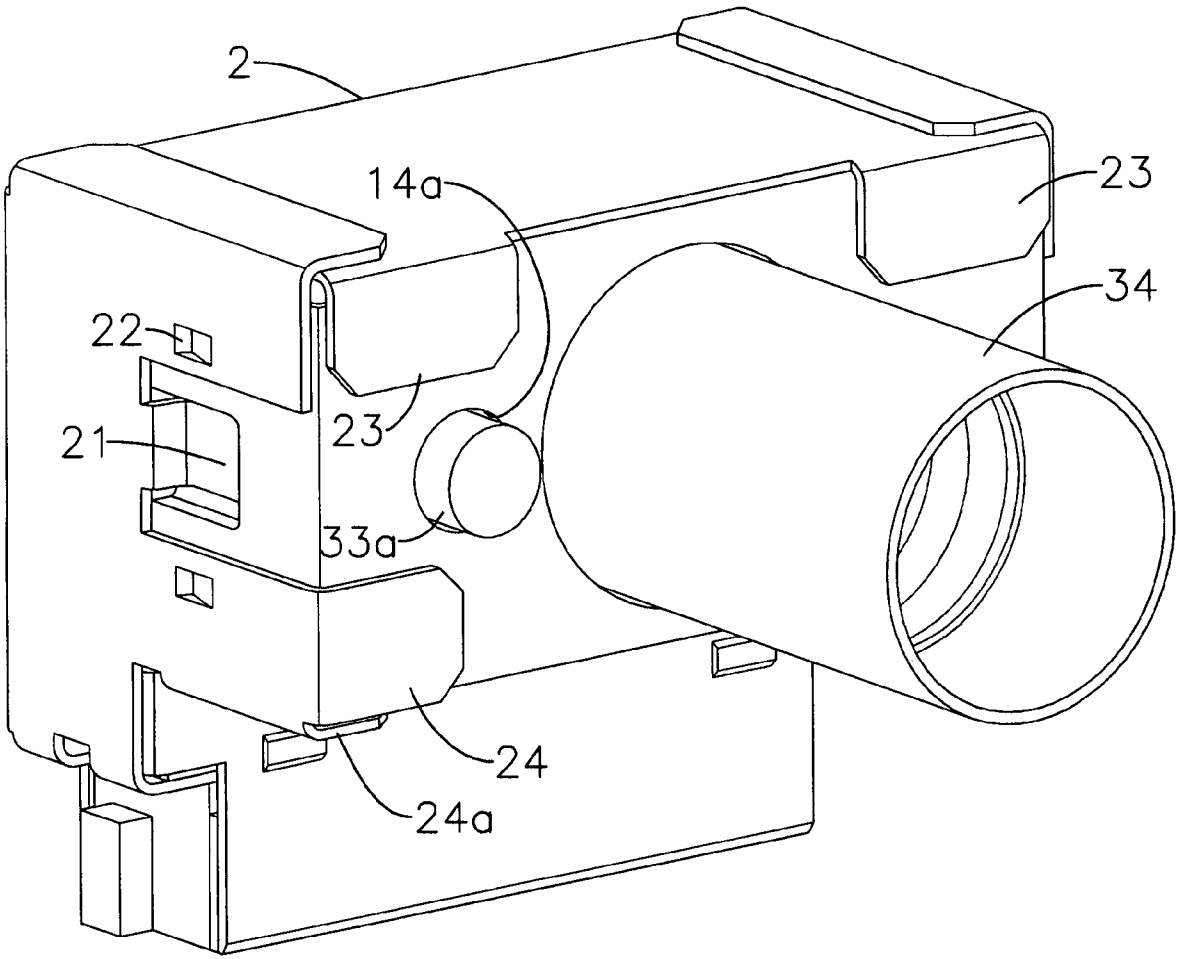
FIG. 5 shows an assembled view of a cable connector according to another embodiment of the present invention.

FIGS. 4 and 5 respectively show an exploded view and an assembled view of a cable connector according to an embodiment of the present invention. This embodiment of the present invention is similar to that described above except for the connector 14A is comprised of a through hole and the connector 33*a* is comprised of a tip. The connector 33A may be connected to the connector 14A such an end portion of the connector 33A protrudes out of the connector 14A. The diameter of the protruded end portion of connector 33A may be enlarged via riveting and etching treatments to fix the connector 33*a* to the connector 14A so as to secure the first metal case 1 on the support base 3.

Figure 6:
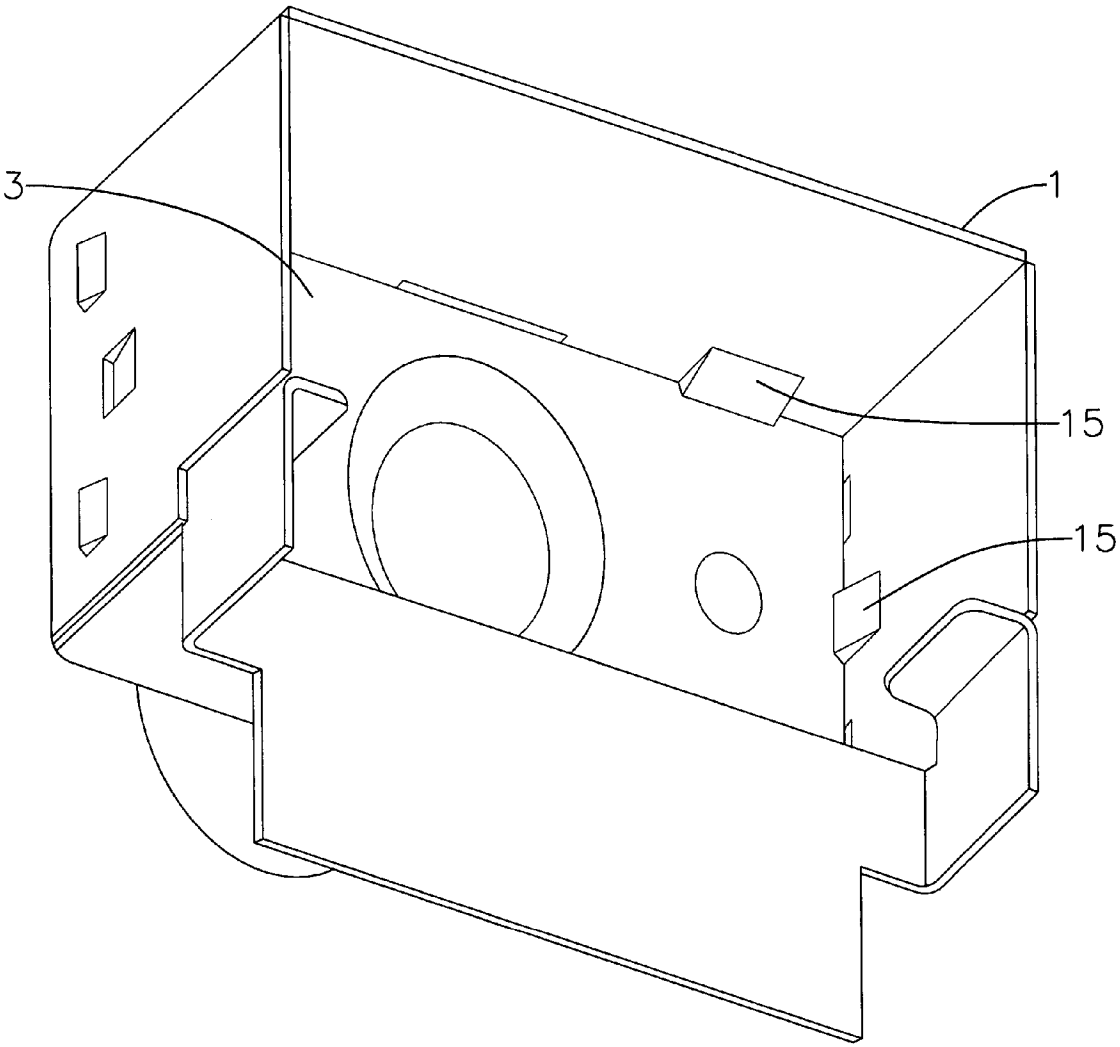
FIG. 6 shows an assembled view of a cable connector according to another embodiment of the present invention.

Referring to FIG. 6, according to another embodiment of the present invention, a plurality of fasteners 15 may be used for securely fixing the first metal case 1 to the support base 3.

Thus, the present invention provides a structure of the cable connector in which all components of the cable connector are properly secured and covered by the second metal case so that the anti-electromagnetic interference capability of the cable connector may be substantially promoted.

Although the invention has been explained in relation to its preferred embodiment, it is to be understood that many other possible modifications and variations can be made without departing from the spirit and scope of the invention as hereinafter claimed.

What is claimed is:

1. A cable connector, comprising:

a first metal case, comprising a slot and a hole on each side of the slot on each of two opposite sidewalls and a thorough hole on formed at a central region of rear surface;

a second metal case, covering the first metal case, comprising a first projection and a protruding block on each side of the first projection on each of two opposite sidewalls for connecting to the slots and the holes on the sidewalls of the first metal case;

a support base, comprising a base;

a hollow threaded fastener, disposed in the support base, wherein the hollow threaded fastener is adopted for passing through the through hole of the first metal case;

a threaded sleeve, for securing the hollow threaded fastener;

a terminal base, comprising a plurality of contact terminals, disposed between the first metal case and the support base;

a cable, comprising a plurality of core wires, for passing through the hollow threaded fastener in the support base, wherein the core wires are electrically connected to the contact terminals.

2. The cable connector defined in claim 1, wherein the threaded sleeve is disposed in the through hole of the first metal case.

3. The cable connector defined in claim 2, wherein said threaded sleeve is adapted for receiving said hollow threaded fastener.

4. The cable connector defined in claim 1, wherein the support base comprises a connector for receiving a pin formed on the first metal case.

5. The cable connector defined in claim 1, wherein the hollow threaded fastener is secured within the threaded sleeve.

6. The cable connector defined in claim 1, further comprising a heat-shrinkable casing tube disposed on an exposed portion of the cable and the threaded sleeve.

* * * * *